US006877683B2

(12) United States Patent
Kang

(10) Patent No.: US 6,877,683 B2
(45) Date of Patent: Apr. 12, 2005

(54) CRUSHER

(75) Inventor: Kwang-Sun Kang, Gunpo (KR)

(73) Assignee: Hyunjun Powtech Co., LTD, Hwaseong (KR)

( * ) Notice: Subject to any disclaimer, the term of this patent is extended or adjusted under 35 U.S.C. 154(b) by 68 days.

(21) Appl. No.: 10/220,050

(22) PCT Filed: Nov. 28, 2001

(86) PCT No.: PCT/KR01/02054

§ 371 (c)(1),
(2), (4) Date: Aug. 27, 2002

(87) PCT Pub. No.: WO02/053291

PCT Pub. Date: Jul. 11, 2002

(65) Prior Publication Data

US 2003/0098374 A1 May 29, 2003

(30) Foreign Application Priority Data

Dec. 30, 2000 (KR) ..... 2000-87275

(51) Int. Cl.[7] ..... B02C 13/26
(52) U.S. Cl. ..... 241/56; 241/188.1
(58) Field of Search ..... 241/56, 158.1, 241/275

(56) References Cited

U.S. PATENT DOCUMENTS 2,016,497 A * 10/1935 Holbeck et al. ..... 241/45

FOREIGN PATENT DOCUMENTS

| | | |
|---|---|---|
| JP | 09-070549 | 3/1997 |
| KR | 1998-15302 | 5/1998 |
| KR | 1998-0059229 | 10/1998 |
| KR | 1999-011750 | 3/1999 |
| KR | 2000-0058246 | 10/2000 |

* cited by examiner

*Primary Examiner*—Mark Rosenbaum
(74) *Attorney, Agent, or Firm*—Robert E. Bushnell, Esq.

(57) ABSTRACT

Disclosed is a crusher. A material is sucked in an upper part on one side of a case part which is formed by horizontally coupling a plurality of cases. The sucked material is horizontally moved and discharged to a lower part on other side. A driving force of a motor is transferred to a side of a rotary shaft which passes through the center from one side to other side of the case part. The crusher includes: a rotary blade part for maintaining an interval from an internal peripheral surface of a central part of the case part and being fixed to a central part of the rotary shaft and rotated in one direction to generate a turbulence in multiple stages; a ring gear part being fixed to an internal peripheral surface of the center of the case part and maintaining a gap from a circumference of the rotary blade part to form a crushing zone in multiple stages; and a discharging fan being fixed to other end part of the rotary shaft and rotated in one direction to discharge a completely crushed grain.

19 Claims, 8 Drawing Sheets

CRUSHER

TECHNICAL FIELD

The present invention relates to a crusher.

BACKGROUND ART

As well known, a crusher is used to crush materials used in various industries as well as fibroid materials and sponge materials into minute grains. The crusher has been suggested in various types. By way of example, a rice hull crusher was assigned Korean Patent Application No. 34568 filed in 1996.

As shown in FIGS. 1*a* and 1*b* (FIGS. 2 and 5 of Korean Patent Application No. 34568), the rice hull crusher comprises: a crushing vessel having a crushing part 12 which is formed in a direction of an inlet 111 and a discharging part 11 which is formed in a direction of an outlet 112; a coupler 15 being directly connected to a power shaft 14 which is installed at the center of the crushing vessel 11 to be rotated at a high speed; an impeller 16 being fixed to a side of the coupler in a direction of the crushing part 12 to generate a whirlwind; a ring frame 17 being fixed to the crushing vessel 11 on an outer wall of the impeller 16 and allowing pulverized rice hull to pass through the discharging part 13; and a discharging fan 18 being fixed to a side of the coupler in a direction of the discharging part 13 to discharge the pulverized rice hull of the discharging part 13 to the outlet 112.

In the crush hull crusher, a crushing path is made in a horizontal-type and a crushing zone is made in a one step-type, such that it is applicable only to pulverization of a foxtail millet having relatively large particle size like the rice hull. It has a difficulty in pulverization of a fibroid material and a sponge material which require minute particle size.

In particular, crushed grains are progressed in one direction, such that a turbulence doesn't occur but a laminar flow occurs, thereby deteriorating collision effect of the crushed grains and resulting in non-uniform particle size. A temperature of the crusher is increased since the crushing process is repeatedly performed, whereby physical properties of the crushed object are changed due to the temperature increase.

Further, the crusher has another problem in economical effect. Since the impeller and the discharging fan are connected to one power shaft, if the crusher is operated for a long time, a severe vibration is caused due to a bending of the power shaft, whereby a cost for repairing and maintaining the crusher is greatly increased due to damage on a bearing. In addition, the crusher has still another problem. Since the discharging fan is formed on an external peripheral surface of a pipe, fine powder generated during the crushing operation is stuck to an internal peripheral surface of the pipe and the alien substance stuck to the internal peripheral surface of the pipe drops off during operation and gets to be included in a normally crushed grain, thereby deteriorating quality.

The applicant disclosed a crusher(Korean Patent Application No. 59427, filed in 1999) wherein a first crushing is performed by forming turbulence and making grains collide together, a second crushing is performed by delaying a residence time of the first crushed grain and shearing the first crushed grain at the same time, and a third crushing is performed by stirring the second crushed grain at a high speed and making the same colliding together. According to the crusher, a heat radiation area of a casing is enlarged so that heat generated inside can be effectively discharged.

As drawn in FIG. 2, the crusher has a crushed object inlet 211 at the center of an upper part of a top casing 21, an air inlet 212 on a side, a discharging mechanism 221 on a side of a lower part of a casing 22 to discharge a completely crushed grain to the outside, an impeller 23 being mounted on an upper part of a rotary shaft S at the center of the ring gear casing 22, and a discharging wing 231 on an inside corresponding to the discharging mechanism 221, the crusher comprises: a first crushing part 24 including a central rotary wing 241 and a first rotary wing 242 which are integrally formed with a first rotary plate 233 on an inside and an outside of an upper end of a fixing member 232 rested on an upper part of the impeller 23, and also including a first ring gear 243 which is formed on an inside wall of the ring gear casing 22 corresponding to the first rotary wing 242; a second crushing part 25 including radially spaced-apart second rotary wings 251 between an edge portion of a lower surface of the first rotary plate 233 and an edge portion of an upper part of a second rotary plate 234 horizontally fixed to a lower end of the fixing member 232, and including a second ring gear 252 which is formed on an inside wall of a central part of the ring gear casing 22 corresponding to a side of the second rotary wings 251; a third crushing part 26 including radially spaced-apart third rotary wings 261 which form double steps on an edge portion of a lower surface of the second rotary plate 234, and including a third ring gear 262 which is formed on an inside wall of a lower part of the ring gear casing 22 corresponding to a side of the third rotary wings 261; and a heat radiation groove 222 being formed on a surface of the ring gear casing 22.

In the earlier application crusher, the first, second, and third crushing parts are formed in a vertical gravity settling type, such that as a residence time of the crushed material becomes shorter, a crushing effect is deteriorated. The third crushing part is semicircular-shaped, such that a crushing efficiency with respect to a crushed object containing lots of fibroid material is deteriorated.

All revolving bodies are connected to one fixing member, such that a high vibration is caused. A part of a bearing for supporting the rotary shaft is positioned inside the crushing part, such that a temperature within the crushing part is increased due to a friction. Therefore, viscosity of grease injected into the bearing is deteriorated in a short time, causing a burning of the bearing. A load is applied respectively to a rotational direction and an axial direction during the operation, thereby causing a greater load.

Furthermore, the discharging wings are radially connected around the external peripheral surface of the pipe, such that the fine crushed grain is stuck to the inside of the pipe and the alien substance stuck to the internal peripheral surface of the pipe drops off during the operation and gets to be included in the normally crushed grain, thereby deteriorating quality. Moreover, in order to clean the inside of the equipment, a plurality of multi-stepped cases should be disadvantageously dismantled and all components inside should be taken to pieces.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Figure 1A:
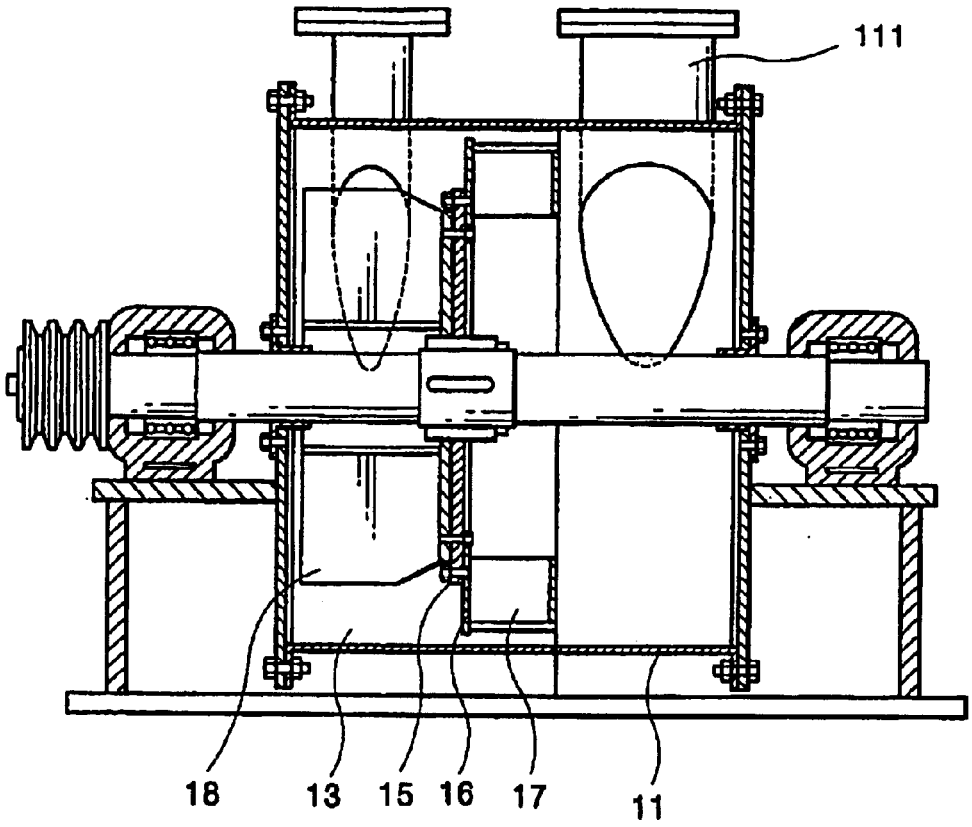
Fig. 1a (PRIOR ART)
FIG. 1*a* illustrates a sectional view of a conventional rice hull crusher and FIG. 1*b* illustrates a side view of the conventional rice hull crusher.
Figure 1B:
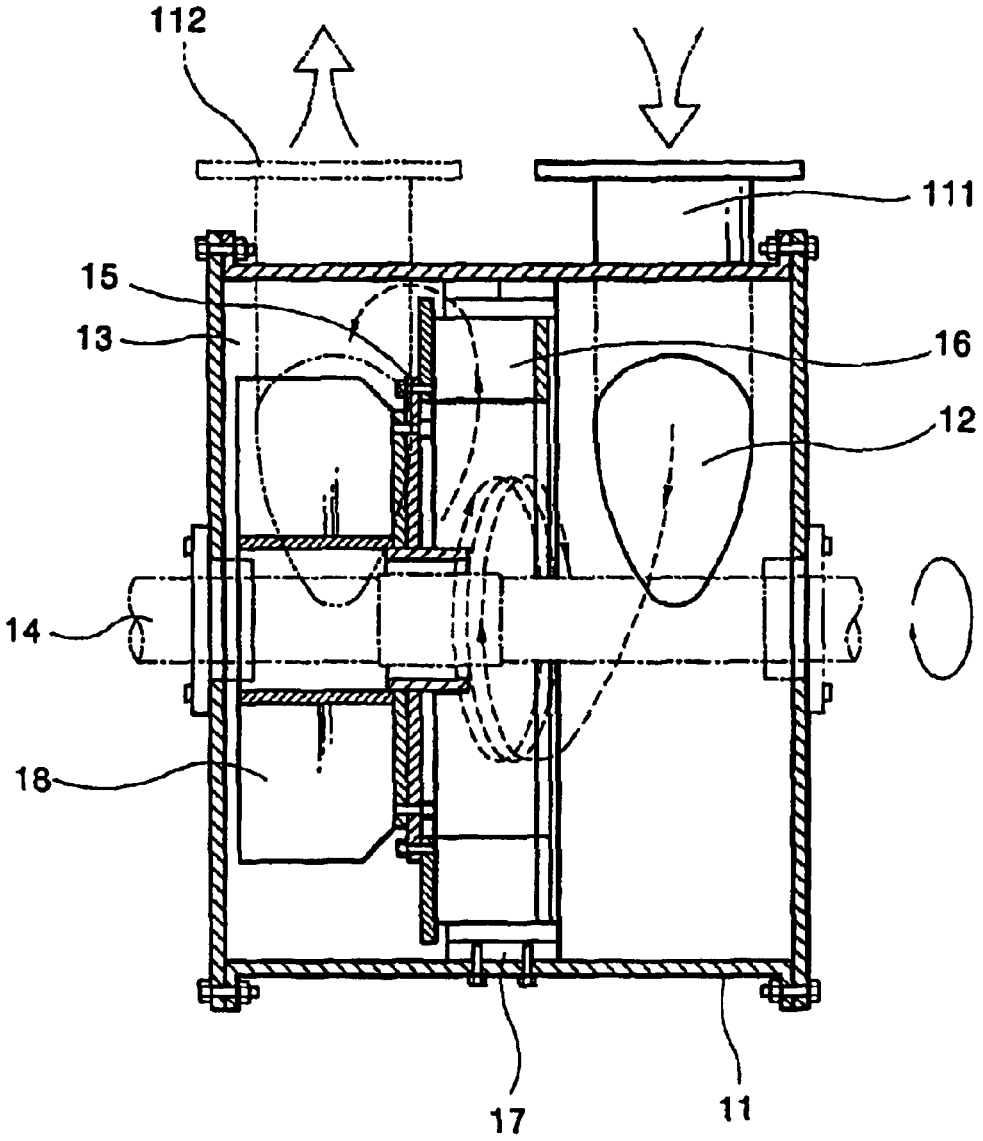
Fig. 1b (PRIOR ART)
Figure 2:
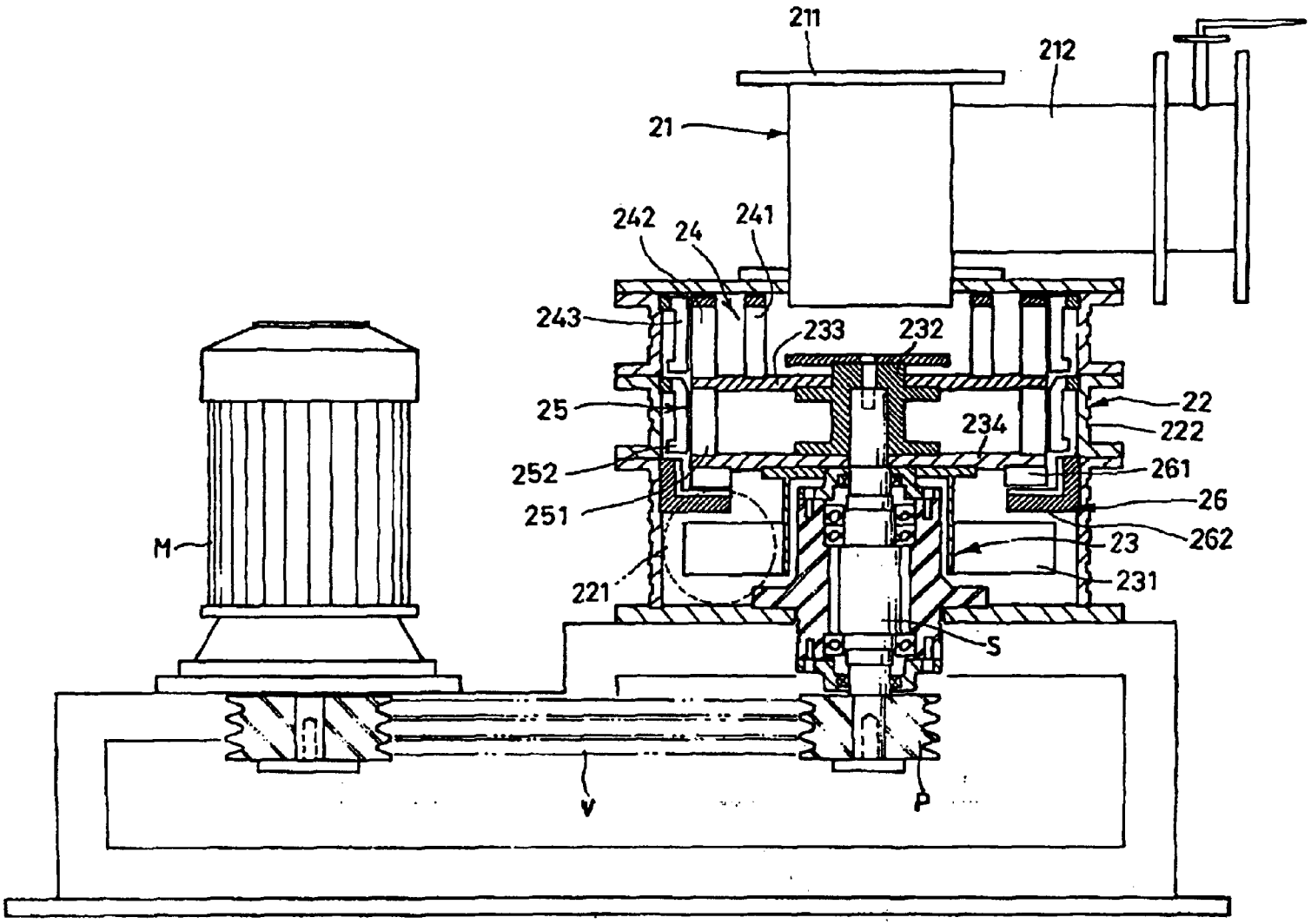
Fig. 2 (PRIOR ART)
FIG. 2 is a sectional view of a crusher of an earlier application.
Figure 3:
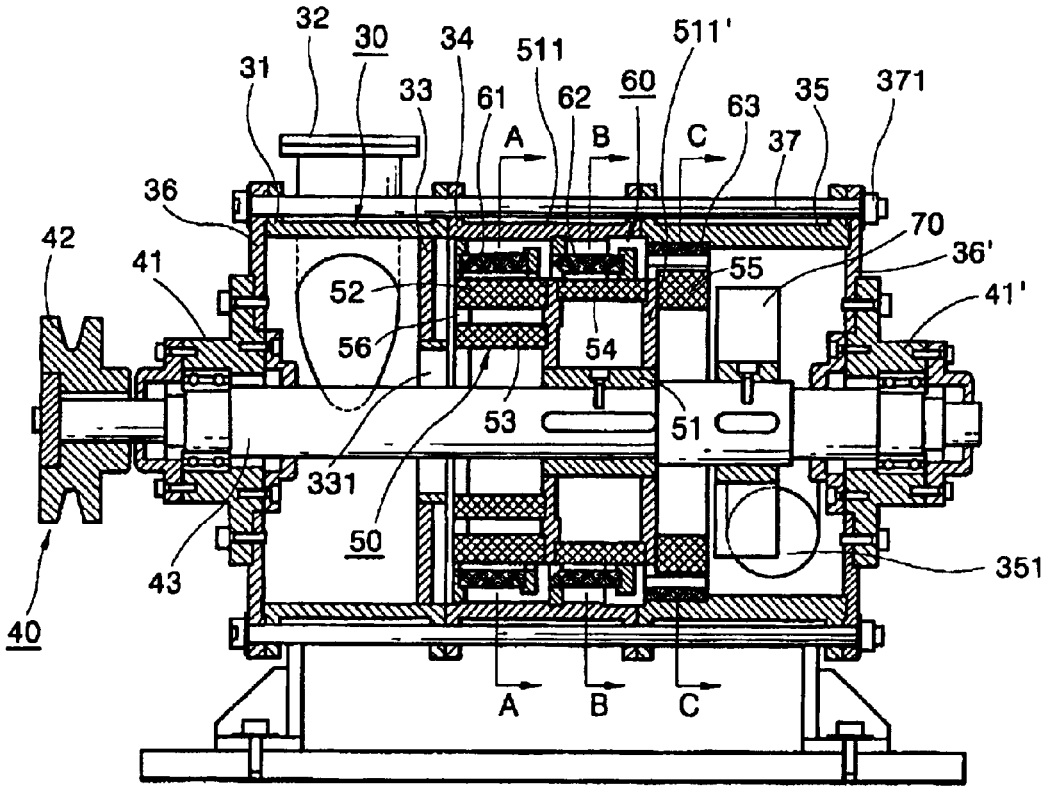
FIG. 3 is a front sectional view according to the present invention.
Figure 4:
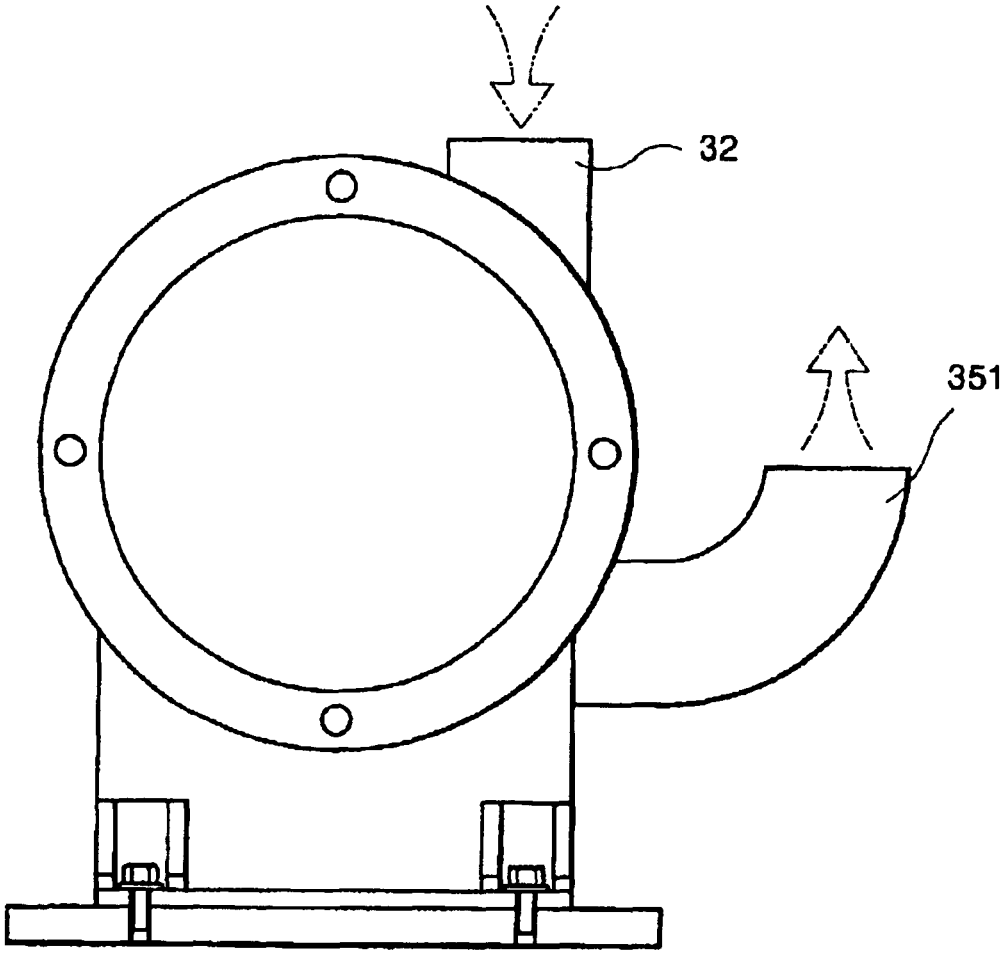
FIG. 4 is a side view according to the present invention.

Reference will now be made in detail to the preferred embodiments of the present invention, examples of which are illustrated in the accompanying drawings. FIG. 3 is a front sectional view according to the present invention, and FIG. 4 is a side view according to the present invention.

A crusher according to the present invention comprises a case part 30 forming a cylindrical space to suck a material on an upper part on one side and discharge the suck material to a lower part on other side by horizontally moving the suck material; a power supplying part 40 for supplying a driving force of a motor to a rotary shaft 43 installed at the center of the case part 30; a rotary blade part 50 being fixed to a central part of the rotary shaft 43 and rotated in one direction to form a turbulence in multiple stages; a ring gear part 60 for maintaining a gap from a circumference of the rotary blade part 50 to form a crushing zone in multiple stages; and a discharging fan 70 being fixed to other end part of the rotary shaft 43 and rotated in one direction to discharge a completely crushed grain.

The case part 30 includes a first case 31 being connected to an inlet 32 on a side of an upper part of a cylinder whose both sides are perforated, allowing a flange to be formed on a circumference of the both sides, and having a ventilation guide member 33 with a guide hole 331 of a predetermined diameter on an internal peripheral surface on other side to guide a material introduced to the inlet 32 to the center on other side; a second case 34 being perforated on both sides, and allowing a flange to be formed on a circumference of the both sides; and a third case 35 being connected to a discharging mechanism 351 on a side of a lower part of a cylinder whose both sides are perforated and allowing a flange to be formed on a circumference on the both sides.

The first, second and third cases 31, 34 and 35 make the respective flanges coinciding with each other to be arranged in a straight line. The flange of the first case 31 on one side and the flange of the third case 35 on other side are closely contacted with covers 36 and 36' which are perforated at the center thereof, and then a fixing shaft 37 passes from the cover 36 on one side to the cover 36' on the other side to be coupled with a nut 371 on other side.

The power supplying part 40 respectively fixes couplings 41 and 41' on an outside of the center of the covers 36 and 36', and the rotary shaft 43 is installed to pass through the center of the couplings 41 and 41'. A pulley 42 is connected to a side end part of the rotary shaft 43 to supply a power of a motor(not shown) to the rotary shaft.

Figure 5A:
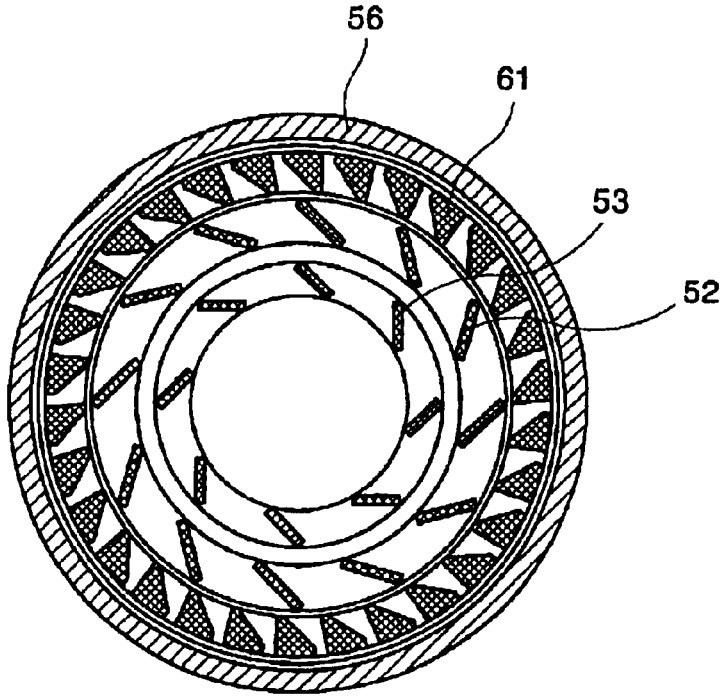
FIGS. 5*a* to 5*c* are side sectional views of FIG. 3 according to the present invention, especially FIG. 5*a* illustrating a sectional view taken through a line A—A, FIG. 5*b* illustrating a sectional view taken through a line B—B, and FIG. 5*c* illustrating a sectional view taken through a line C—C.

The rotary blade part 50 is fixed to an outer wall of the rotary shaft 43. For this, a rotary boss 51 allows circular disks 511 and 511' which are perforated at the center and have the same diameter to face each other on both sides thereof. As illustrated in FIG. 5*a*, a plurality of rotary blades 52 having a slope at a predetermined angle in a direction are formed on a circumference of an outside surface of the circular disk 511 on the one side of the rotary boss 51, and a plurality of second rotary blades 53 having a slope at a predetermined angle in the same direction as the first rotary blades 52 are formed on a perimeter inwardly spaced from the first rotary blades 52. A support plate 56 is attached and fixed to an outside surface of the first rotary blades and the second rotary blades 52 and 53.

Figure 5B:
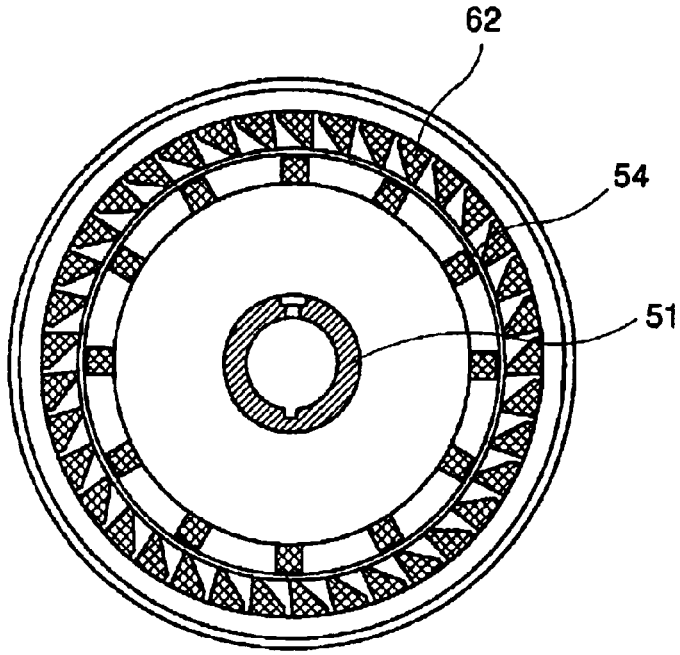
Figure 5C:
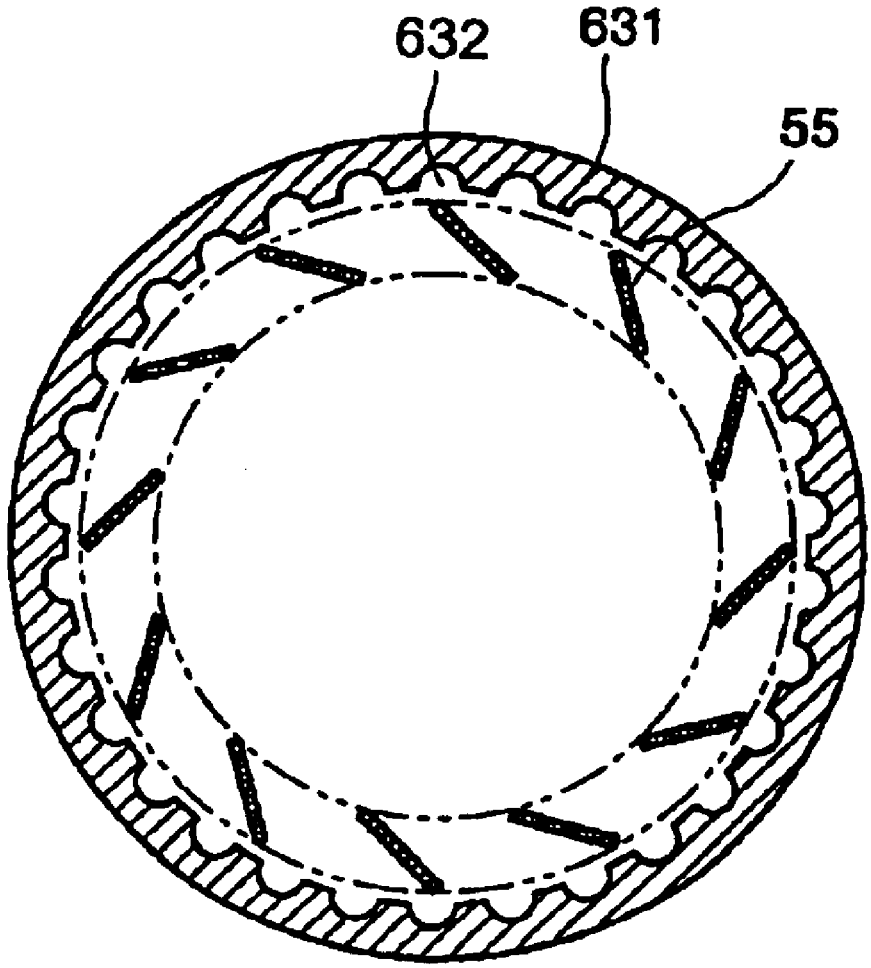

As shown in FIG. 5*b*, a plurality of third rotary blades 54 are radially formed at uniform intervals on a circumference of an outer wall between the circular disks 511 and 511' of the rotary boss 51 and allow an uneven portion to be formed on an outside surface thereof. As shown in FIG. 5*c*, a plurality of fourth rotary blades 55 are slantly formed at a predetermined angle on a circumference of an outside surface of the circular disk 511' on other side of the rotary boss 51. A blade edge on an external peripheral side of the fourth rotary blades 55 is more outwardly protruded than a diameter of the circumference of the circular disk 511' on the other side of the rotary boss 51.

In the ring gear part 60, as shown in FIG. 5*b*, a first ring gear 61 is fixed to an internal peripheral wall on a side of the second case 34 corresponding to an external peripheral surface of the first rotary blade 52 of the rotary blade part 50. As shown in FIG. 5*b*, a second ring gear 62 is fixed to an internal peripheral wall on other side of the first ring gear 61 corresponding to an external peripheral surface of the third rotary blade 54. The first ring gear 61 and the second ring gear 62 are same in construction as the ring gear of the earlier application.

As illustrated in FIG. 5*c*, a third ring gear 63 is fixed to an internal peripheral wall on a side of the third case 35 corresponding to an external peripheral surface of the fourth rotary blade 55. In the third ring gear 63, circularly recessed friction grooves 632 are consecutively formed on an inside surface of an annular body 631 having a width capable of accommodating a side surface on an edge portion of the fourth rotary blade 55. Such a construction of the third ring gear 63 is used when a solid material such as a powder is crushed into a fine powder.

Figure 6:
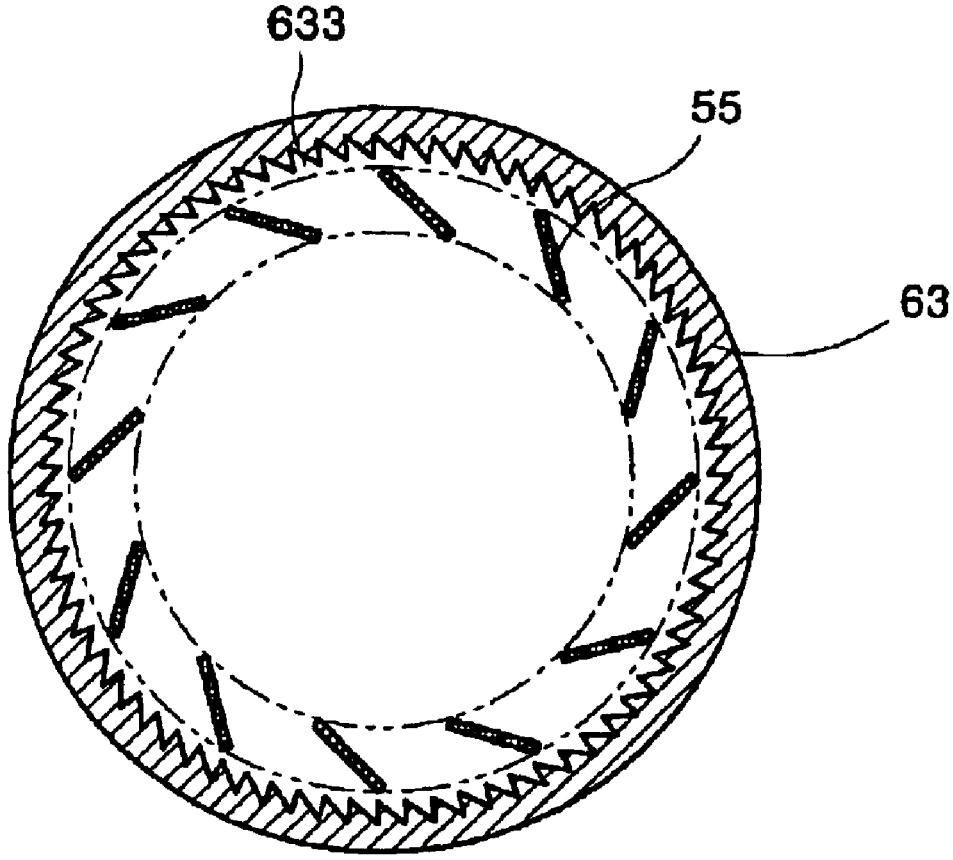
FIG. 6 is a side sectional view of a third ring gear according to another preferred embodiment of the present invention.

According to another preferred embodiment of the third ring gear 63, as shown in FIG. 6, the unevenly recessed friction grooves 633 with a sharp blade edge are consecutively formed on the inside surface of the annular body 631 with a width capable of accommodating the side surface of the edge portion of the fourth rotary blade 55. This third ring gear 64 is selectively used to crush a fibroid material into a fine powder.

Hereinafter will be explained operation of the crusher constructed as above according to the present invention.

If a motor is operated and the rotary shaft 43 connected to the pulley 42 is rotated in one direction, the rotary blade part 50 fixed to the central part of rotary shaft 43 is rotated. When a suction force is accordingly generated inside the equipment, the object to be crushed is introduced through the inlet 32 formed on the upper part on one side of the first case 31 and the air is sucked from the outside the same time. The object to be crushed and the air introduced into the inside of the first case 31 through the inlet 32 are rapidly forwarded to the central part on one side of the second case 34 via the guide hole 331 of the ventilation guide member 33 which is mounted on other side of the first case 31.

The object introduced into the second case 34 along with the air is first crushed in the crushing zone between the first ring gear 61 and the first and second rotary blades 52 and 53 by receiving an energy which is consecutively accelerated by the first and the second rotary blades 52 and 53 of the rotary blade part 50. Then, the object is crushed in the crushing zone between the second ring gear 62 and the third rotary blade 54 by receiving an energy which is accelerated by the third rotary blade 54. The object is further crushed in the crushing zone between the third ring gear and the fourth rotary blade 55, and then discharged to the outside through the discharging mechanism 351 connected to the lower part on one side of the third case 35 by a blast force of the discharging fan 70.

As a consequence, according to the crusher of the present invention, the crushed object introduced along with the air in the crushing process is spirally rotated in a horizontal direction to form a strong air current, and uniformly crushed in the crushing zone defined between the rotary blade part 50 in which the four rotary blades 52, 53, 54 and 55 are consecutively formed and the ring gear part 60 in which the three ring gears 61, 62 and 63 are consecutively formed.

In the horizontal-type structure, the load generated during the operation is applied only in a rotational direction, whereby load and noise of the driving force are reduced, the crushed grain is prevented from being stuck to between components which are rotated at a high speed, and respective components are easily and successively dismantled for cleaning and replacing purposes.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

INDUSTRIAL APPLICABILITY

As stated above, according to a crusher of the present invention, a material is sucked in an upper part on one side of a case part which is formed by horizontally coupling a plurality of cases. The sucked material is horizontally moved and discharged to a lower part on other side. A driving force of a motor is transferred to a side of a rotary shaft which passes through the center of the case from one side to other side. The crusher includes: a rotary blade part for maintaining an interval from an internal peripheral surface of a central part of the case part, and being fixed to a central part of the rotary shaft and rotated in one direction to generate a turbulence in multiple stages; a ring gear part being fixed to an internal peripheral surface of the center of the case part for maintaining a gap from a circumference of the rotary blade part to form a crushing zone in multiple stages; and a discharging fan being fixed to other end part of the rotary shaft and rotated in one direction to discharge a completely crushed grain. The crusher according to the present invention can minimize a crushing deviation and effectively crush a high fibroid material and a high molecular substance by enabling the material introduced along with the air from the outside to be spirally rotated in the horizontal direction so as to form a strong air current, achieve easy repair and maintenance and extend the life of the equipment by enabling a load generated during an operation to be applied only in the rotational direction so as to minimize load and noise of a driving force, and improve quality of a grain and ensure an easy cleaning and replacing by preventing a crushed grain from being stuck to rotating components.

What is claimed is:

1. A crusher, comprising:

a case part for forming a cylindrical space, said case part having an inlet to suck a material to be crushed and an outlet to discharge the material;

a power supplying part comprising a rotary shaft installed at the center of the case part for supplying a driving force of a motor to said rotary shaft;

a rotary blade part fixed to the rotary shaft and rotated to generate a turbulence in multiple stages;

a ring gear part for maintaining a gap from a circumference of the rotate blade part, said ring gear part and said rotary blade part forming consecutively connected multiple crushing zones, wherein said material spirally rotates and is crushed consecutively when said material passes through said crushing zones; and a discharging fan fixed to an end part of the rotary shaft and rotated to discharge the crushed material.

2. The crusher of claim 1, wherein the case part includes:

a first case accommodating said inlet on one side of an upper part and provided with a ventilation guide member having a guide hole;

a second case interconnecting with the first case by said guide hole through which the material is transferred by a centrifugal force generated by said rotary blade part; and a third case accommodating a discharging mechanism and being consecutively connected to the second case.

3. The crusher of claim 2, wherein the rotary blade part includes:

a rotary boss fixed to the rotary shaft;

a first circular disk and a second circular disk mounted on said rotary boss, respectively, said first circular disk facing said second circular disk;

a plurality of first rotary blades having a slope at a predetermined angle in one direction, said plurality of first rotary blades mounted on an outside surface of the first circular disk;

a plurality of second rotary blades having a slope at a predetermined angle in the same direction as the plurality of first rotary blades, said plurality of second rotary blades mounted on said outside surface of the first circular disk, wherein said material passes through said guide hole, said plurality of first rotary blades, and then said plurality of second rotary blades;

a plurality of third rotary blades radially formed at uniform intervals between the first circular disk and the second circular disk, each third rotary blade having an uneven portion on the surface of each third rotary blade; and a plurality of fourth rotary blades having a slope at a predetermined angle on an outside of the second circular disk.

4. The crusher of claim 3, wherein the ring gear part includes:

a first ring gear fixed to the second case corresponding to an external peripheral surface of the first rotary blades;

a second ring gear fixed to the second case corresponding to an external peripheral surface of the third rotary blades; and a third ring gear mounted on the third case corresponding to an external peripheral surface of the plurality of fourth rotary blades.

5. The crusher of claim 4, wherein the third ring gear has unevenly recessed friction grooves with a sharp blade edge.

6. The crusher of claim 4, wherein the third ring gear has circularly recessed friction grooves.

7. A crusher, comprising:

a case having an inlet through which an air and a material to be crushed are fed and an outlet through which the material is discharged;

a shaft horizontally positioned at the center of said case;

a guide partitioning said case, said guide having a center hole through which the material fed from said inlet is transferred;

a rotary boss mounted on said shaft;

a first circular disk and a second circular disk mounted on said rotary boss for rotating along with said shaft, said first circular disk facing said second circular disk;

a plurality of blades comprising first blades, second blades, third blades, and fourth blades, said first blades and said second blades mounted on said first circular disk, said third blades mounted between said first circular disk and said second circular disk, said fourth blades mounted on said second circular disk, said first, second, third, and fourth blades generating a centrifugal force and a turbulence flow to radially rotate said material; and a plurality of ring gears comprising a first ring gear, a second ring gear, and a third ring gear, said first, second and third ring gears forming crushing zones with said second, third and fourth blades, respectively, wherein said material is crushed in the crushing zones while the material is radially rotating by the centrifugal force and the turbulence flow; and a fan mounted on said shalt to discharge the crushed material through said outlet.

8. The crusher of claim 7, wherein the third ring gear has unevenly recessed friction grooves with a sharp blade edge.

9. The crusher of claim 7, wherein the third ring gear has circularly recessed friction grooves.

10. The crusher of claim 7, wherein each of said first blades has a slope at a predetermined angle in one direction.

11. The crusher of claim 10, wherein each of said second blades has a slope at a predetermined angle in the same direction as the first blades.

12. The crusher of claim 10, wherein said third blades are radially formed at uniform intervals, and the outward surfaces of the third blades are uneven.

13. The crusher of claim 7, wherein said third blades are radially formed at uniform intervals, and the outward surfaces of the third blades are uneven.

14. The crusher of claim 7, further comprising:

a support plate attached to the first blades and the second blades.

15. The crusher of claim 7, wherein said fourth blades are slantwise formed at a predetermined angle on a circumference of said second circular disk.

16. The crusher of claim 7, wherein the edges of the fourth blades are more outwardly protruded than the edges of the second circular disk.

17. A crusher, comprising:

a case having an inlet through which an air and a material to be crushed are fed and an outlet through which the material is discharged;

a shaft horizontally positioned at the center of said case;

a guide partitioning said case, said guide having a center hole through which the material fed from said inlet is transferred;

a rotary boss mounted on said shaft;

a first circular disk and a second circular disk mounted on said rotary boss for rotating along with said shaft, said first circular disk facing said second circular disk;

a plurality of blades comprising first blades, second blades, third blades, and fourth blades, said first blades and said second blades mounted on said first circular disk, said third blades mounted between said first circular disk and said second circular disk, said fourth blades mounted on said second circular disk, said first, second, third, and fourth blades generating a centrifugal force and a turbulence flow to radially rotate said material, said first and said second blades having a slope at a predetermined angle in one direction, said third blades radially formed at uniform intervals, said fourth blades slantwise formed at a predetermined angle on said second circular disk, wherein the edges of the fourth rotary blades are more outwardly protruded than the edges of the second circular disk;

a plurality of ring gears comprising a first ring gear, a second ring gear, and a third ring gear, said first, second and third ring gears forming crushing zones with said second, third and fourth blades, respectively; and a fan mounted on said shaft, said fan discharging the crushed material through said outlet, wherein said material is crushed in the crushing zones while the material is radially rotating by the centrifugal force and the turbulence flow.

18. The crusher of claim 17 wherein the third ring gear has unevenly recessed friction grooves with a sharp blade edge.

19. The crusher of claim 17, wherein the third ring gear has circularly recessed friction grooves.

* * * * *